United States Patent [19]

Keeler

[11] 4,105,132

[45] Aug. 8, 1978

[54] TAMPER-PROOF CLOSURE

[76] Inventor: Frederick D. Keeler, 43 Strobel Rd., Trumbull, Conn. 06611

[21] Appl. No.: 715,884

[22] Filed: Aug. 19, 1976

[51] Int. Cl.[2] ..... B65D 55/02; B65D 85/56; A61J 1/00

[52] U.S. Cl. ..... 215/216; 215/217

[58] Field of Search ..... 215/216, 217, 252, 253, 215/256, 330, 337

[56] References Cited

U.S. PATENT DOCUMENTS 3,831,797 8/1974 Stevens, Jr. ..... 215/216

3,917,097 11/1975 Uhlig ..... 215/216

*Primary Examiner*—George T. Hall

*Attorney, Agent, or Firm*—Darby & Darby

[57] ABSTRACT

A one-piece thermoformed tamper-proof closure which provides an indication showing that the closure has been removed from the container on which it was placed. The closure has a chilled resistant feature in that it is made difficult to open by requiring a squeezing action. In addition, the closure is provided with means for providing a firm locking arrangement after the closure has been opened.

12 Claims, 5 Drawing Figures

TAMPER-PROOF CLOSURE

Many types of closures exist which are of the so-called tamper-proof type in which a visual indication is provided that the closure has been previously removed from the container, such as a bottle, on which it was originally placed. This is generally accomplished by providing a tab which is broken off as the closure is first unthreaded, a band which is torn, etc. In addition to this, it is sometimes desirable to provide a closure made so that it will make it more difficult for a child to open. In the past, this was accomplished in a variety of ways, for example, by providing mating lugs and spaces respectively on the closure and the container, or vice versa, requiring a downward pressure on the top of the closure in order to release it from the container, etc.

The present invention relates to a novel closure having the advantages of being both tamper-proof and being more difficult for a child to open than a conventional closure. Further, the closure of the present invention provides an arrangement wherein an additional sealing force can be provided after the closure has once been removed from the container.

In accordance with the present invention, a thermoformed closure is provided which is integrally formed of one piece of plastic material. The thermoforming step takes place from a sheet of plastic material of substantially uniform thickness. Closures of this general type are disclosed in U.S. Pat. Nos. 3,482,725 to Norman Exton, granted Dec. 9, 1969 and 3,606,063 to Childs and Ostrowski, granted Sept. 20, 1971, all of which are assigned to the assignee of the subject application. The closure of the present invention has a top wall, which may or may not have an additional sealing member, such as a liner, deformable sealing ring, (see Exton U.S. Pat. No. 3,487,785), etc. A skirt wall depends from the top wall and fastening means, in the form of threads, are provided thereon to fasten the closure to the container. Extending outwardly from the bottom of the skirt wall, and substantially parallel to the top wall, is the top wall of a shroud ring on which is provided tamper-proof members in the form of tabs which are to engage a locking projection on the container and be broken off as the closure is unthreaded. The locking projection on the container also provides a child-proof feature by coacting with several locking indents formed on the closure shroud ring which require that the closure first be squeezed to move the locking indents out of contact with the locking projection before the closure can be unthreaded.

It is therefore an object of the present invention to provide a novel closure having tamper-proof and child resistant features.

A further object is to provide a closure which is thermoformed and has tamper-proof tabs which are broken away when the closure is unthreaded from the container with the closure also having a child resistant feature.

An additional object is to provide a tamper-proof closure of thermoformed material which is more difficult for a child to open.

Yet another object is to provide a thermoformed closure of deformable material having a skirt wall with locking indents thereon in which the skirt wall must be squeezed and deformed to clear the locking indents from a locking projection on the container so that the closure can be removed.

A further object is to provide a thermoformed closure in which the skirt wall is provided with locking indents to mate with a locking projection on the container, several indents being provided so that the sealing force on the closure can be adjusted.

Other objects and advantages of the present invention will become more apparent upon reference to the following specification and annexed drawings, in which.

Figure 1:
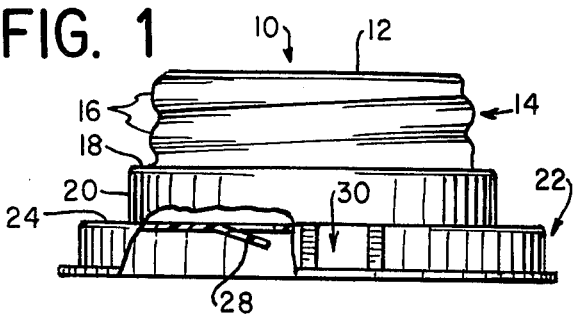
FIG. 1 is an elevational view of a closure in accordance with the present invention shown partly broken away.
Figure 3:
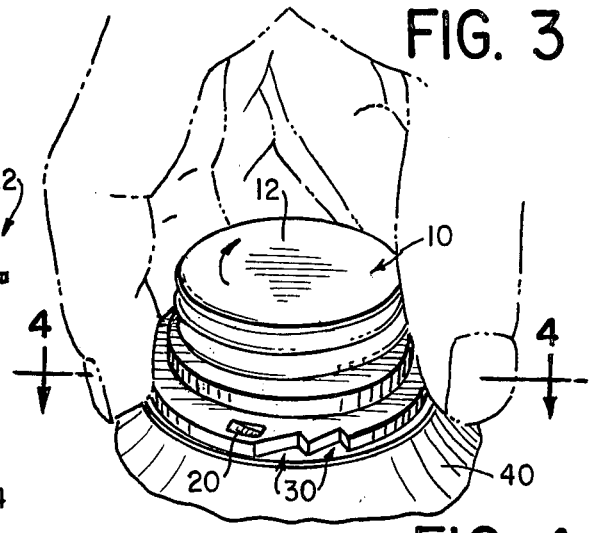
FIG. 3 is a perspective view showing the closure fastened on the container.

Referring to the drawings, the closure 10 is a thermoformed one-piece member of plastic material. The closure is thermoformed from sheet plastic material, or plastic-elastomeric laminate composites (see U.S. Pat. No. 3,866,845) by vacuum or pressure-forming techniques using male or female molds, or in combination thereof. Suitable techniques and apparatus therefore are disclosed, for example, in Childs and Ostrowski U.S. Pat. No. 3,743,128, granted July 3, 1973 which is assigned to the assignee of this application.

The closure 10 is formed with the usual top wall 12 from which depends a skirt wall 14 having threads 16 thereon. The bottom of the skirt wall terminates in a transition piece which includes an annular step 18 extending outwardly from the skirt wall 14 and generally parallel to the top wall 12 and a downwardly extending wall 20, which is generally parallel to the skirt wall 14. Wall 20 extends outwardly of the crest of threads 16.

A shroud ring 22 extends outwardly from wall 20 of the transition piece. The shroud ring has a shoulder 24 which is generally parallel to both the closure top wall 12 and step 18 and a downwardly extending wall 26. The shroud ring is dimensioned to have a larger diameter than that of the sealing lip of the container. Thus, it will always clear the container sealing lip and protect it, that is, the container sealing lip will not generally come into contact with the bottom of the skirt wall as in a conventional closure. The material for the closure can be, for example, polypropylene, polyethylene, ABS plastic, composites, etc. The sheet material is relatively thin, for example, from about 0.010 inches to about 0.045 inches so that it can be manually deformed by applying finger pressure.

A plurality of tamper-proof tabs 28 are formed in shoulder 24 of the shroud ring. The tabs 28 are shown as being generally rectangular in shape. However, they can have any desired shape, for example, square, triangular, trapezoidal, etc. The tabs 28 are formed by any suitable process during or after the forming of the closure. The process used can include, for example, lancing, cutting, etc. The tamper-proof tabs 28 are formed so that they extend downwardly from shoulder 24, that is, toward the closure interior.

A plurality of locking indents 30, here shown as two, **30*a* and 30*b*, are formed on wall 26 of shroud ring 22. Each locking indent 30 has first and second walls 31 and 32 which extend angularly inwardly of the closure. An angle of somewhat less than 90 degrees is formed at the outer juncture 33 between the second wall 32** of indent 30*a* and the first wall 31 of 30*b*. Similarly, an angle of somewhat less than 90 degrees is formed at the inner juncture 34 of the first and second walls 31, 32 of each indent. The angles at the junctures 33, 34 can be varied. As pointed out previously, the closure material is such that the shroud ring walls can be deformed by applying a modest amount of finger pressure. Further, as shown, one of the locking tabs 28 lies closely adjacent the first wall 31 of locking indent 30*a*, and extends into the chord area defined by radials drawn from the beginning of its wall 31 and its juncture 34.

Figure 2:
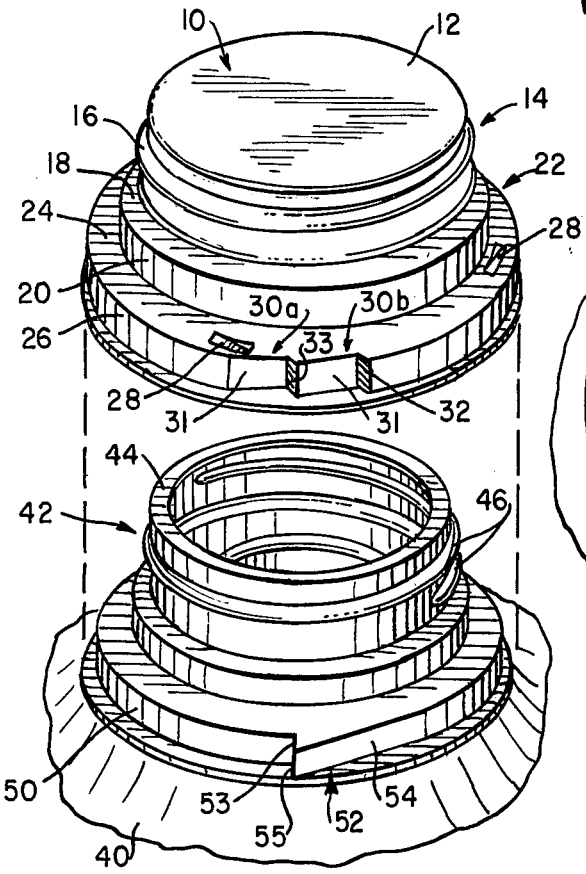
FIG. 2 is a perspective exploded view showing the container and closure.

FIG. 2 shows the container 40 which also forms a part of the subject invention. The container 40 may be of any suitable shape and of any suitable material, for example, plastic, metal or glass. The container is formed with neck 42 having a top sealing lip 44. Threads 46 are formed on the neck to mate with the closure threads 16.

A generally circular locking ring 50 is formed at the bottom of the thread area 46. The locking ring is of a diameter such that the closure shroud ring 24 can fit thereover. Also formed as part of the locking ring 50 is a locking projection 52.

Projection 52 has a first wall 53 which extends outwardly from the circumference of the major part of the ring and lies generally transverse to a tangent drawn to the ring circumference. A second wall 54 slopes back toward the main circumference of the ring forming an acute angle with first wall 53 at the juncture 55.

The location of the tamper-proof tabs 28 on closure shroud ring wall 24 is such that it can engage the first wall 53 of locking projection 52 as the closure is rotated in a counter-clockwise direction. That is, the tamper-proof tabs 28 lie outside of the circumference of the major portion of locking ring 50.

The operation of the invention is as follows. The closure 10 is threaded onto the container neck 44 by turning it clockwise. This can be done manually or by automatic capping equipment. As the closure rides down over the neck, the locking tabs clear the main portion of locking ring 50 and ride over the angled wall 54 of locking projection 52, that is, the direction of closure rotation is such that the downwardly extending tabs 28 will be pushed upwardly as they engage angled walls 54.

Figure 4:
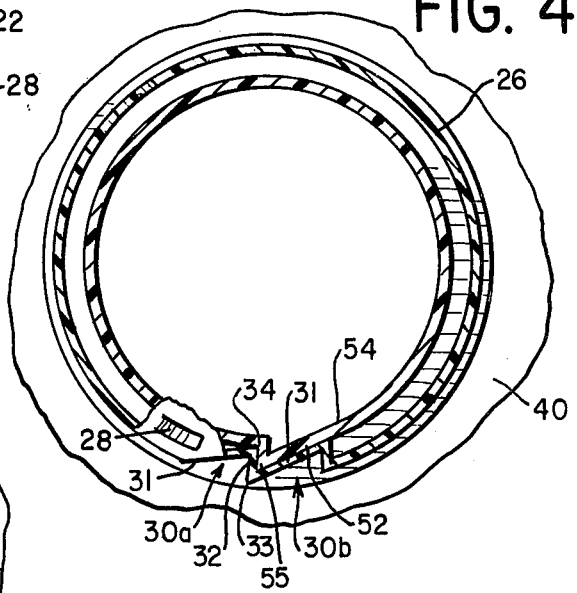
FIG. 4 is a cross-sectional view of the closure on the container.

As the closure is turned further down onto the container neck, the locking indents 30 will also ride over the locking projection 52 since walls 31 of the indents slope in the same direction as projection wall 52. Also, there is a certain amount of "give" to the walls of the locking indent in view of the fact that they are made of a thermoformed material which is relatively thin. The closure is preferably designed with respect to the container so that the container will be fully sealed, that is, the closure top wall 12 or its liner — if one is used, will engage the container sealing lip 44 when the second wall 32 of locking indent 30*a* is engaged with wall 53 of locking projection 52. This is shown in FIG. 4.

Figure 5:
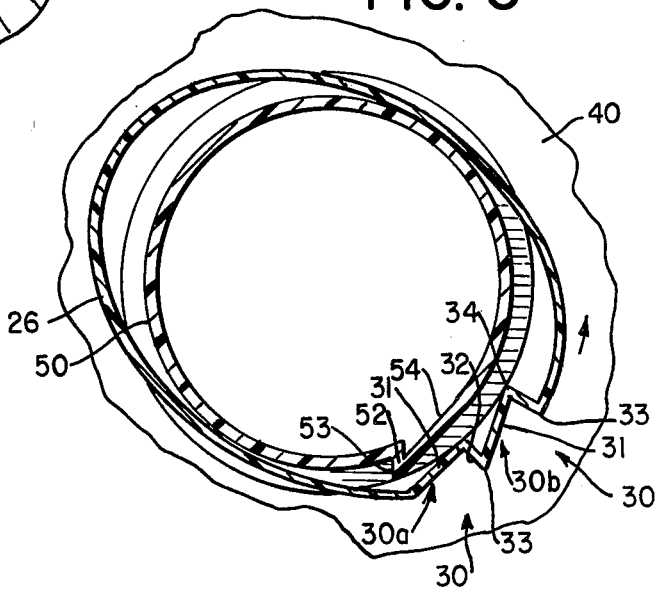
FIG. 5 is a cross-sectional view showing the closure being unthreaded from the container.

To remove the closure from the container, it is rotated in a counter-clockwise direction. The threading is initially retarded due to the fact that the locking indent 30*a* on the closure will engage and "hang up" on locking projection wall 53. In order to clear the locking indent off the locking projection, it is first necessary to squeeze the flexible shroud ring, with the direction of force shown as in FIG. 5. The force applied by the fingers is sufficient to clear indent 30*a* off of the locking projection by a sufficient amount so that it will ride over the locking projection. It should be understood that a complete clearance is not necessary since the locking indents also have some flexibility so that they can deform as they ride over the peak 55. The necessity for the squeezing force to be applied provides the child resistant feature.

As the closure is rotated further counter-clockwise, the first tamper-proof tab 28 will engage locking projection wall 53 and be torn off as the closure is rotated. The first tamper-proof tab is torn during the time that the squeezing force is still being applied. This makes it even more difficult for a child to open the container. The second tab 28, that is, the one furthest from the indents, is then torn off as the closure is rotated further in a counter-clockwise direction. The tearing off of the tabs 28 provides a visual indication to a subsequent user that the container has been opened. Also, it makes the closure more difficult to remove.

The finger pressure applied to the closure to clear the locking indents off the locking projection is applied until the closure is unthreaded by a sufficient distance upwardly so that the locking indents on the closure shroud ring clear the top shoulder of locking ring 50. At this time, the pressure can be released and the remainder of the unthreading carried out in the normal manner until the closure is fully removed.

To rethread the closure onto the container after it has once been removed, the action followed when the closure was first threaded onto the container is carried out. That is, the closure is rotated in a clockwise direction and, if necessary, a force is applied to the closure shroud ring to bring locking indents 30 at least partially out of engagement with locking projection 52. As discussed above, since the outside wall 54 of the locking projection 52 is angled in the same direction as walls 31 of the locking indents, the latter will ride over the former as the closure is being rethreaded.

In some cases, due to a deformation of the sealing liner which is often found adjacent closure top wall 12, it is required that a greater amount of torque be applied to the closure upon reasealing than during the initial sealing. The fact that there are two locking indents means that the closure can be threaded further on the container in a clockwise direction. For example, locking indent 30*b* would lock up on the locking projection if the closure is threaded further clockwise than during the initial sealing. While two locking indents 30 are shown, it should be understood that a greater number can be provided in order to achieve this feature of the invention.

To unthread the closure again, it is necessary to apply force by the finger to clear the indents 30 off the locking projection 50. In this case, the tamper-proof tabs will have no effect since they have already been broken off.

What is claimed is:

1. A thermoformed closure thermoformed from sheet plastic material of substantially uniform thickness and of a semi-resilient character, said thermoformed closure having a top wall, a skirt wall with fastening means thereon depending downwardly from said top wall, a shroud ring extending outwardly from the lower end of the skirt wall, said shroud ring including a shoulder which is generally parallel to the closure top wall and a first wall depending downwardly from said shoulder, said top wall, side wall and shroud ring being of substantially the same thickness throughout except in the areas where deformed, and at least one locking indent means deformed from said shroud ring and extending inwardly from said first wall, the first wall of said shroud ring being deformable so that the locking indent can be moved.

2. A closure as in claim 1 wherein said locking indent means includes first and second walls extending inwardly from said shroud ring first wall and meeting at an angle inwardly of the shroud ring first wall.

3. A closure as in claim 2 wherein said first and second walls of said locking indent are at least partially deformable.

4. A closure as in claim 1 wherein there are a plurality of said locking indent means formed on said shroud ring.

5. A thermoformed closure formed from sheet plastic material of a semi-resilient character and having a top wall, a skirt wall with fastening means thereon depending downwardly from said top wall, a shroud ring extending outwardly from the lower end of the shirt wall, said shroud ring including a shoulder which is generally parallel to the closure top wall and a first wall depending downwardly from said shoulder, at least one locking indent means formed on said shroud ring extending inwardly from said first wall, the first wall of said shroud ring being deformable so that the locking indent can be moved, and a tamper-proof tab formed in said shoulder of the shroud ring, said tamper-proof tap comprising a portion of said shoulder which is cut and extends downwardly therefrom, said portion being hinged to the shoulder.

6. The combination comprising:

a thermoformed closure thermoformed from sheet plastic material of substantially uniform thickness and of a semi-resilient character, said thermoformed closure having a top wall, a skirt wall with fastening means thereon depending downwardly from said top wall, a shroud ring extending outwardly from the lower end of the skirt wall, said shroud ring including a shoulder which is generally parallel to the closure top wall and a first wall depending downwardly from said shoulder, at least one locking indent means deformed from said shroud ring and extending inwardly from said first wall, the first wall of said shroud ring being deformable so that the locking indent can be moved, a container having a neck portion with fastening means thereon onto which said closure is to be fastened, a locking projection extending outwardly from the container neck portion, said locking projection fitting into the closure locking indent to retard the closure from being unfastened from the container, said closure locking indent at least partially clearing the container locking projection as force is applied to the closure shroud ring to move the locking indent.

7. The combination of claim 6 wherein a said closure locking indent includes first and second walls extending inwardly from the shroud ring first wall and forming an angle at their juncture, said container locking projection including a first wall which extends outwardly from the container neck portion and a second wall which angles from the end of the first wall back toward the container neck portion.

8. The combination of claim 7 wherein the second wall of said closure locking indent and the second wall of the container locking projection slant in the same direction so that the closure locking indent can ride over the locking projection as the closure is being fastened down onto the container neck.

9. The combination of claim 8 wherein said first and second walls of said locking indent are at least partially deformable.

10. The combination of claim 6 wherein a hinged tamper-proof tab is formed in said shoulder of the shroud ring with a free end which extends downwardly therefrom, said free end of the tamper-proof tab engaging the locking projection and being torn from the closure as the closure is unfastened from the container.

11. The combination of claim 10 wherein the container locking projection includes a first wall which extends outwardly from the container neck, said tamper-proof tab positioned to engage the locking projection first wall when the shroud ring is deformed for the closure locking indent to clear the container locking projection.

12. The combination of claim 10 wherein there are a plurality of said tamper-proof tabs formed on said shroud ring shoulder.

* * * * *